US012358095B2

(12) United States Patent
Ide et al.

(10) Patent No.: US 12,358,095 B2
(45) Date of Patent: Jul. 15, 2025

(54) SUBSTRATE GRINDING DEVICE AND SUBSTRATE GRINDING METHOD

(71) Applicant: OKAMOTO MACHINE TOOL WORKS, LTD., Gunma (JP)

(72) Inventors: Satoru Ide, Gunma (JP); Takahiko Mitsui, Gunma (JP); Tsubasa Bando, Gunma (JP); Kazuhiro Takaoka, Gunma (JP)

(73) Assignee: OKAMOTO MACHINE TOOL WORKS, LTD., Gunma (JP)

( * ) Notice: Subject to any disclaimer, the term of this patent is extended or adjusted under 35 U.S.C. 154(b) by 1062 days.

(21) Appl. No.: 16/565,548

(22) Filed: Sep. 10, 2019

(65) Prior Publication Data

US 2020/0086450 A1 Mar. 19, 2020

(30) Foreign Application Priority Data

Sep. 13, 2018 (JP) ..... 2018-171475

(51) Int. Cl.
*B24B 27/00* (2006.01)
*B24B 7/04* (2006.01)
*B24B 7/22* (2006.01)

(52) U.S. Cl.
CPC ..... *B24B 27/0076* (2013.01); *B24B 7/04* (2013.01); *B24B 7/228* (2013.01)

(58) Field of Classification Search
CPC ..... B24B 7/04; B24B 7/228; B24B 27/0076; B24B 37/10; B24B 37/30; B24B 41/047; B24B 41/053
USPC ..... 451/41, 57, 65, 262, 285, 287, 289, 388
See application file for complete search history.

(56) References Cited

U.S. PATENT DOCUMENTS 6,106,369 A * 8/2000 Konishi ..... B24B 49/16 451/287
6,120,349 A * 9/2000 Nyui ..... B24B 49/12 451/6
6,312,320 B2 * 11/2001 Sato ..... G11B 23/505 451/287
6,585,572 B1 * 7/2003 Saldana ..... B24B 53/017 451/291

(Continued)

FOREIGN PATENT DOCUMENTS

JP H05129259 A * 5/1993
JP H08336741 A 12/1996

(Continued)

OTHER PUBLICATIONS

Machine Translation of KR-20080113682-A ("Park Translation") (Year: 2008).*

(Continued)

*Primary Examiner* — Monica S Carter
*Assistant Examiner* — Jonathan R Zaworski
(74) *Attorney, Agent, or Firm* — RANKIN, HILL & CLARK LLP

(57) ABSTRACT

Provided is a substrate grinding device including: a work table rotatable with the work table sucking and holding a substrate; a cup wheel-type first grinding wheel configured to grind the rotating substrate while rotating, the substrate being held by the work table; and a cup wheel-type second grinding wheel configured to grind the substrate along with grinding by the first grinding wheel while rotating in a close vicinity of the substrate.

8 Claims, 3 Drawing Sheets

(56) References Cited

U.S. PATENT DOCUMENTS

| | | | | |
|---|---|---|---|---|
| 2008/0318497 | A1 | 12/2008 | Kimura | |
| 2015/0044944 | A1 * | 2/2015 | Chen | B24B 21/12 451/64 |
| 2015/0239089 | A1 | 8/2015 | Hirayama et al. | |

FOREIGN PATENT DOCUMENTS

| | | | | |
|---|---|---|---|---|
| JP | 2007203432 | A | * | 8/2007 |
| JP | 2009004406 | A | | 1/2009 |
| JP | 2014065082 | A | | 4/2014 |
| JP | 2014097551 | A | * | 5/2014 |
| JP | 2017103441 | A | | 6/2017 |
| KR | 20080113682 | A | * | 12/2008 |
| TW | 201544255 | A | | 12/2015 |
| TW | 201812892 | A | | 4/2018 |

OTHER PUBLICATIONS

Machine Translation of JP-H05129259-A ("Kuniyoshi translation") (Year: 1993).*

* cited by examiner

SUBSTRATE GRINDING DEVICE AND SUBSTRATE GRINDING METHOD

CROSS-REFERENCE TO RELATED APPLICATION

This application is based on Japanese Patent Application No. 2018-171475 filed with the Japan Patent Office on Sep. 13, 2018, the entire content of which is hereby incorporated by reference.

BACKGROUND ART

1. Technical Field

An embodiment of the present disclosure relates to a substrate grinding device and a substrate grinding method.

2. Related Art

Typically, it has been known as a substrate grinding method that a rotating cup wheel-type grinding wheel is downfed to an upper surface of a substrate as a processing target object, which is rotating while being held on a work table, to grind the substrate. For example, JP-A-2017-103441 discloses that downfeed grinding is performed for a silicon substrate fixed to a suction chuck by means of a cup wheel-type grinding wheel.

Moreover, JP-A-2009-4406 discloses, for example, a semiconductor wafer grinding device including two grinding units of a grinding unit for coarse grinding and a grinding unit for finish grinding. According to the grinding device disclosed in this document, a wafer held on a chuck table is sent to a primary processing position below the coarse grinding unit in such a manner that a turn table rotates in an R-direction by a predetermined angle. At this position, the wafer is coarsely ground by the coarse grinding unit. Subsequently, the wafer is sent to a secondary processing position below the finishing grinding unit in such a manner that the turn table rotates again in the R-direction by the predetermined angle. At this position, the wafer is finish-ground by the finish grinding unit.

Further, JP-A-2014-65082 discloses, for example, a grinding device for a substrate of sapphire, SiC, GaN, or the like held on a holding table. For this grinding device, a coarse grinding position for coarsely grinding the substrate, a semi-finish grinding position for performing semi-finish grinding for the substrate, and a finish grinding position for finish-grinding the substrate are set. The grinding device is provided at each of the coarse grinding position, the semi-finish grinding position, and the finish grinding position. Further, these grinding devices are linearly arranged. The substrate is serially processed in the order of coarse grinding, semi-finish grinding, and finish grinding.

SUMMARY

A substrate grinding device includes: a work table rotatable with the work table sucking and holding a substrate; a cup wheel-type first grinding wheel configured to grind the rotating substrate while rotating, the substrate being held by the work table; and a cup wheel-type second grinding wheel configured to grind the substrate along with grinding by the first grinding wheel while rotating in a close vicinity of the substrate.

DETAILED DESCRIPTION

Figure 1:
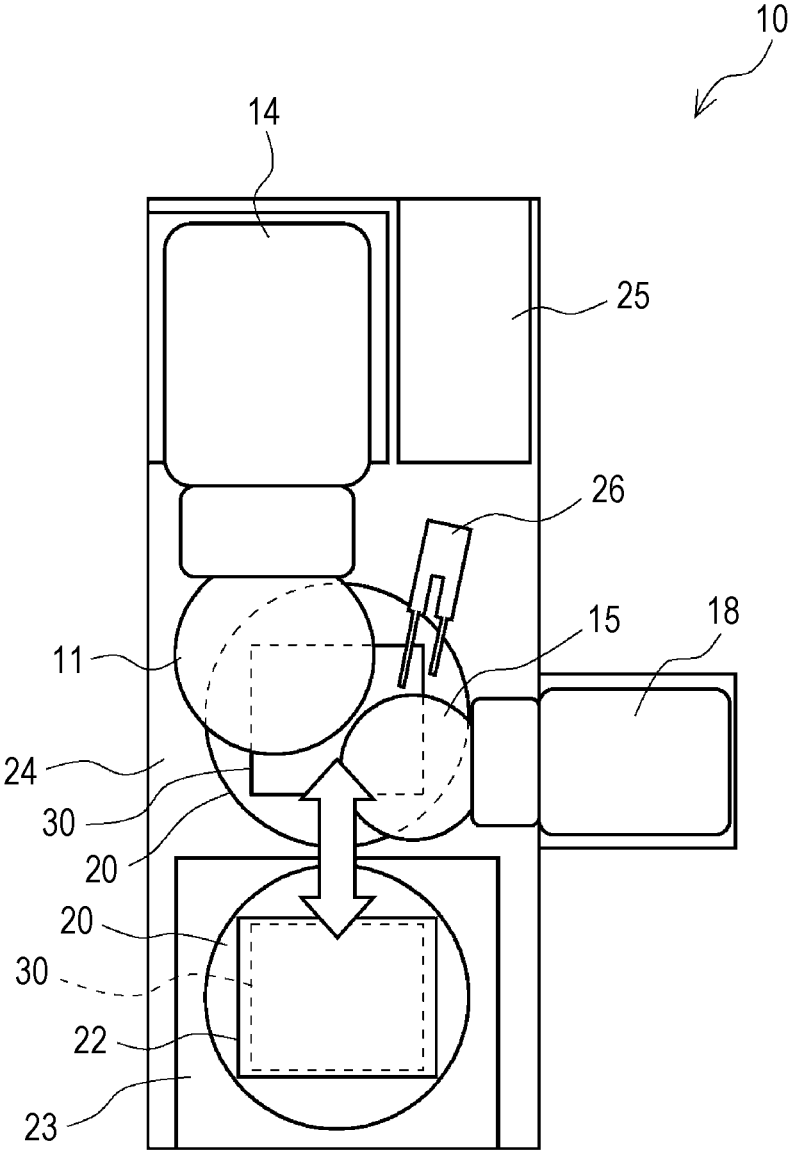
FIG. 1 is a plan view of the outline of a substrate grinding device according to an embodiment of the present disclosure.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

However, for the above-described substrate grinding devices and methods by the typical techniques, there are points to be improved for implementing efficient grinding. Specifically, the technique of efficiently grinding, with high accuracy, a wafer level package (WLP) recently grown in size and a panel level package (PLP) as a large-size mounting substrate further grown in size as compared to the WLP has been demanded, for example.

For example, in a downfeed-type substrate grinding device configured to grind the rotating substrate by means of the rotating cup wheel-type grinding wheel as in the typical technique disclosed in JP-A-2017-103441, processing time increases when the large-size mounting substrate with warpage is ground by a single type of grinding wheel.

Specifically, in the large-size mounting substrate such as the PLP, not only is a substrate size large, but also warpage of the substrate is great. The substrate of this type is in such a shape that an outer peripheral portion is raised as compared to a center portion even in a state in which the substrate sticks to a chuck mechanism of a work table by vacuum suction. Generally, the outer peripheral portion of the substrate comes into contact with the grinding wheel about 100 to 200 μm earlier than the center portion. Such a portion with a thickness of 100 to 200 μm is ground at a sending speed in finish grinding, and therefore, the processing time increases.

Moreover, for grinding of the large-size mounting substrate, it has been demanded that a resin grinding surface is finished with high accuracy and a copper electrode is also ground and finished with high accuracy. For this reason, a grinding wheel leading to a great abrasion amount is used. As described above, in grinding of the large-size mounting substrate, warpage of the substrate is great, and the grinding time is long. Thus, many grinding wheels are used.

Moreover, in the typical techniques disclosed in JP-A-2009-4406 and JP-A-2014-65082, multiple types of grinding wheels such as a grinding wheel for coarse grinding and a grinding wheel for finish grinding are used to sequentially execute grinding for the substrate moved by, e.g., the turn table. For applying this method to the large-size mounting substrate, the substrate grinding device is enlarged. That is, the large-size mounting substrate such as the PLP has a larger area than, e.g., that of a silicon wafer. Thus, a large-size substrate grinding device including work table movement positions applicable to two steps of a coarse grinding step and a finish grinding step has been demanded. However, it is difficult to enlarge the substrate grinding device.

Further, the large-size mounting substrate such as the PLP has unique warpage. Such a substrate has such characteristics that after warpage of the substrate has been eliminated by grinding of the substrate chucked to the work table, another warpage occurs when the substrate is detached from the work table and the substrate is chucked again to the work table. For this reason, it is difficult to execute high-accuracy finish grinding in a method in which equipment for coarse grinding and equipment for finish grinding are provided, a substrate is detached from a work table of the coarse grinding equipment after coarse grinding has been performed with the substrate being chucked to the work table, and the substrate is delivered to the finish grinding equipment to perform finish grinding with the substrate being chucked to a work table of the finish grinding equipment.

One object of the present disclosure is to provide a substrate grinding device and a substrate grinding method configured to efficiently grind a large-size substrate with high accuracy.

According to one aspect of the present disclosure, a substrate grinding device (the present substrate grinding device) includes: a work table rotatable with the work table sucking and holding a substrate; a cup wheel-type first grinding wheel configured to grind the rotating substrate while rotating, the substrate being held by the work table; and a cup wheel-type second grinding wheel configured to grind the substrate along with grinding by the first grinding wheel while rotating in a close vicinity of the substrate.

Further, according to one aspect of the present disclosure, a substrate grinding method (the present substrate grinding method) includes: a chucking step of causing a substrate to stick to a rotatable work table; and a grinding step of rotating the work table to rotate the substrate held on the work table and simultaneously moving cup wheel-type first and second grinding wheels closer to the substrate while the first and second grinding wheels are rotating, thereby grinding the substrate.

The present substrate grinding device includes the cup wheel-type first grinding wheel configured to grind the substrate, which is rotating with being held on the work table, while rotating, and the cup wheel-type second grinding wheel configured to grind the substrate along with grinding by the first grinding wheel while rotating in a close vicinity of the substrate. With this configuration, the substrate can be simultaneously ground by the first grinding wheel and the second grinding wheel without the need for changing the position of the substrate. As a result, an increase in the size of the substrate grinding device can be suppressed, and the large-size substrate can be efficiently ground.

For example, a large-size mounting substrate with great warpage, such as a PLP, can be simultaneously ground by the first grinding wheel and the second grinding wheel without the need for delivering the substrate by, e.g., a turn table. Thus, a short high-accuracy grinding step is implemented.

Moreover, according to the present substrate grinding device, the first grinding wheel may be configured such that a grinding area thereof has a greater diameter than the radius of the work table, and may be provided at such a position that the grinding area includes the center of rotation of the substrate. Further, the second grinding wheel may be configured such that a grinding area thereof has a greater diameter than the radius of the work table, and may be provided at a position not contacting the first grinding wheel in the vicinity of the center of rotation of the substrate. With this configuration, grinding from an outer peripheral portion of the substrate to the vicinity of the center of rotation can be performed by the second grinding wheel while an entire processing target surface of the substrate including the center of rotation can be ground with high accuracy by the first grinding wheel.

Further, according to the present substrate grinding device, the particle size of the first grinding wheel may be greater than the particle size of the second grinding wheel. That is, the abrasive grain size of the first grinding wheel may be smaller than the abrasive grain size of the second grinding wheel. In addition, the first grinding wheel and the second grinding wheel may be configured such that after the first grinding wheel and the second grinding wheel have approached the substrate to grind the substrate in a state in which the second grinding wheel is closer to the substrate than the first grinding wheel is to the substrate, the first grinding wheel approaches the substrate to grind the substrate in a state in which the second grinding wheel is separated from the substrate. With this configuration, coarse grinding of the substrate can be performed by the second grinding wheel, and thereafter, finish grinding of the substrate can be performed by the first grinding wheel. Thus, steps from coarse grinding to finish grinding can be efficiently executed. Moreover, a machining margin of the first grinding wheel for finish grinding can be extremely reduced. Thus, the amount of abrasion of the first grinding wheel can be reduced.

Specifically, according to the present substrate grinding device, grinding time can be reduced to about ½, and a grinding wheel running cost can be reduced to about ⅓ as compared to the grinding method of the typical technique for executing the entire grinding step from coarse grinding to finish grinding by a single type of grinding wheel.

Moreover, the present substrate grinding method includes the chucking step of causing the substrate to stick to the rotatable work table; and the grinding step of rotating the work table to rotate the substrate held on the work table and simultaneously moving the cup wheel-type first and second grinding wheels closer to the substrate while the first and second grinding wheels are rotating, thereby grinding the substrate. With this configuration, an increase in the size of the substrate grinding device is suppressed while efficient substrate grinding is performed with a smaller number of times of delivery of the work table.

Further, according to the present substrate grinding method, the first grinding wheel may be configured such that the grinding area thereof has a greater diameter than the radius of the work table, and at the grinding step, may be sent to such a position that the grinding area includes the center of rotation of the substrate. In addition, the second grinding wheel may be configured such that the grinding area thereof has a greater diameter than the radius of the work table, and at the grinding step, may be sent to the position not contacting the first grinding wheel in the vicinity of the center of rotation of the substrate. With this configuration, grinding from the outer peripheral portion of the substrate to the vicinity of the center of rotation can be performed by the second grinding wheel while the entire processing target surface of the substrate including the center of rotation can be efficiently ground with high accuracy by the first grinding wheel.

Moreover, according to the present substrate grinding method, the particle size of the first grinding wheel may be greater than the particle size of the second grinding wheel. Further, the grinding step may include the coarse grinding step of moving the first grinding wheel and the second grinding wheel closer to the substrate to grind the substrate in a state in which the second grinding wheel is closer to the substrate than the first grinding wheel is to the substrate, and the finish grinding step executed after execution of the coarse grinding step to move the first grinding wheel closer to the substrate to grind the substrate in a state in which the second grinding wheel is separated from the substrate. With this configuration, coarse grinding of the substrate can be performed by the second grinding wheel, and thereafter, finish grinding of the substrate can be performed by the first grinding wheel. Thus, the amount of polishing of the first grinding wheel can be reduced while, e.g., the large-size mounting substrate can be efficiently ground with high accuracy.

Hereinafter, a substrate grinding device according to an embodiment of the present disclosure will be described in detail with reference to the drawings. FIG. 1 is a plan view of the outline of the substrate grinding device 10 according to the embodiment of the present disclosure. The substrate grinding device 10 is, with reference to FIG. 1, a device configured to grind or polish a substrate 30.

The substrate 30 as a processing target object of the substrate grinding device 10 may be, for example, a large-area mounting substrate such as a PLP, a package substrate, other laminated substrates, a semiconductor substrate, or a substrate for an element such as a capacitor. From a principal surface of the substrate 30, the substrate grinding device 10 grinds or polishes, with high accuracy, e.g., a resin layer, a copper electrode, and a semiconductor element forming the substrate 30. The substrate grinding device 10 can be efficiently processed even in the case of the large-area substrate 30 with warpage.

The substrate grinding device 10 has a standby stage 23 for placing the substrate 30 as the processing target object, a grinding stage 24 for executing grinding of the substrate 30, a work table 20 configured to hold the substrate 30, a finish grinding wheel 11 as a first grinding wheel, and a coarse grinding wheel 15 as a second grinding wheel.

The standby stage 23 is a stage used for fixing the substrate 30 targeted for processing to the work table 20 before grinding and detaching a chucking of the substrate 30 from the work table 20 after grinding.

An attachment housing 22 for causing the substrate 30 to stick to a vacuum chuck of the work table 20 is provided above the standby stage 23. At the standby stage 23, the substrate 30 mounted on an upper surface of the work table 20 is sandwiched between the attachment housing 22 moving down from above and the work table 20 on a lower side, and is fixed to the work table 20 by vacuum suction. After the substrate 30 has been fixed to the work table 20, the attachment housing 22 moves up away from the substrate 30.

The work table 20 is a table rotatable with the work table 20 holding the substrate 30 at a grinding step. The work table 20 is provided to move substantially horizontally between the standby stage 23 and the grinding stage 24 so that the substrate 30 can be delivered.

Specifically, the substrate 30 sticks to the upper surface of the work table 20 at the standby stage 23. Thereafter, the work table 20 moves to a predetermined position at the grinding stage 24, and rotates with the work table 20 supporting the substrate 30. After grinding of the substrate 30 has ended, the work table 20 moves to a predetermined position at the standby stage 23.

The grinding stage 24 is a position for executing the step of grinding the substrate 30. The substrate 30 sticking to the upper surface of the work table 20 is, together with the work table 20, delivered to the grinding stage 24. At the grinding stage 24, the step of grinding the substrate 30 is performed by the finish grinding wheel 11 and the coarse grinding wheel 15.

The finish grinding wheel 11 is a cup wheel-type grinding wheel configured to grind the substrate 30 while rotating. The finish grinding wheel 11 is supported by a finish grinding column 14 so that the finish grinding wheel 11 can move in an upper-to-lower direction. The finish grinding wheel 11 is provided above the work table 20 and the substrate 30 delivered to the grinding stage 24.

The coarse grinding wheel 15 is a cup wheel-type grinding wheel configured to grind the substrate 30 while rotating. The coarse grinding wheel 15 is supported by a coarse grinding column 18 so that the coarse grinding wheel 15 can move in the upper-to-lower direction. The coarse grinding wheel 15 is provided above the work table 20 and the substrate 30 delivered to the grinding stage 24.

While rotating simultaneously, the finish grinding wheel 11 and the coarse grinding wheel 15 simultaneously approach the rotating substrate 30 held on the work table 20, and in this manner, the substrate 30 can be ground.

Moreover, a sizing device 26 is provided at the grinding stage 24. The sizing device 26 is a device configured to accurately detect, for grinding the substrate 30 with high accuracy, an upper surface position of the substrate 30 to measure the processing dimensions of the substrate 30.

A control board 25 is provided at the substrate grinding device 10. The control board 25 has, for example, an input section configured to input various types of information, a monitor configured to display various types of information, and an arithmetic processing section configured to perform various types of arithmetic processing. Based on input information, the control board 25 executes various types of arithmetic processing to monitor and control processing for the entirety of the substrate grinding device 10, for example.

Moreover, a not-shown cleaning solution spray device configured to clean the finish grinding wheel 11 and the coarse grinding wheel 15 may be provided at the substrate grinding device 10. The cleaning solution spray device has a spray nozzle for spraying a cleaning solution onto the finish grinding wheel 11, and a spray nozzle for spraying the cleaning solution onto the coarse grinding wheel 15.

From the spray nozzles, the cleaning solution is, with a pressure of 3 MPa to 17 MPa, sprayed onto the vicinity of grinding wheel blade edges 12, 16 (see FIG. 3) of the finish grinding wheel 11 and the coarse grinding wheel 15 separated from the substrate 30, for example. Accordingly, shavings having adhered to the finish grinding wheel 11 and the coarse grinding wheel 15 at the grinding step can be washed away, and therefore, the substrate 30 can be ground with high accuracy.

Figure 2:
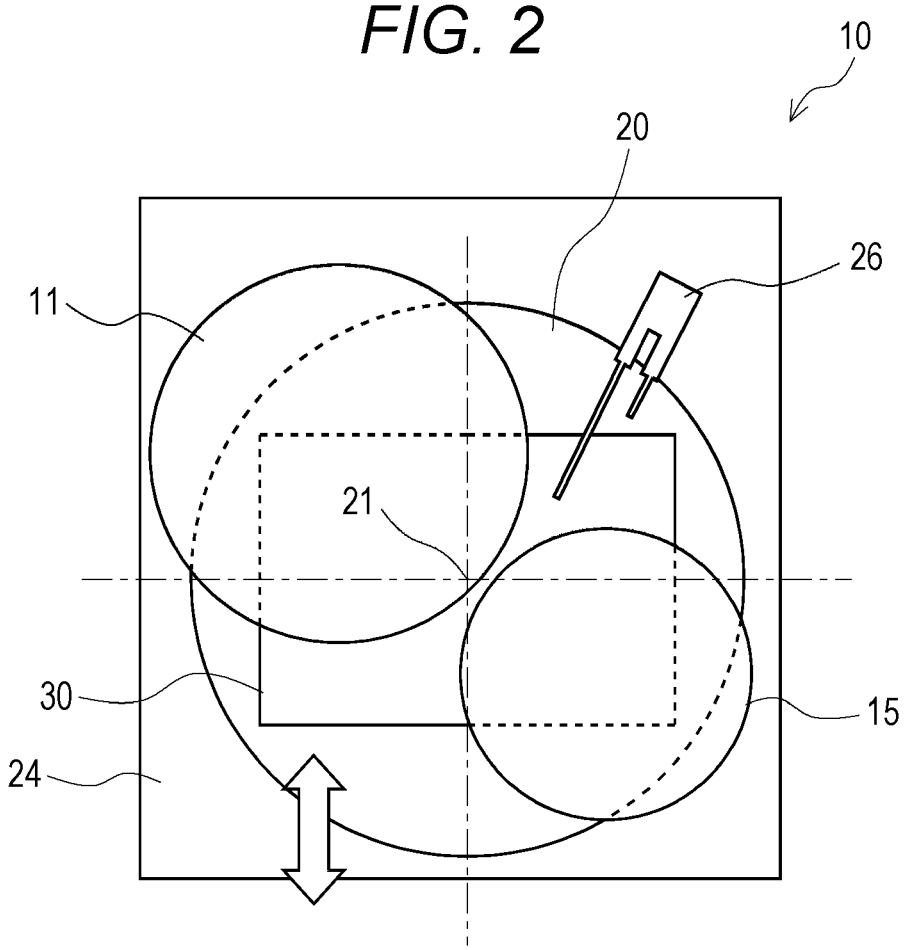
FIG. 2 is a plan view of the vicinity of a grinding stage of the substrate grinding device according to the embodiment of the present disclosure.
Figure 3:
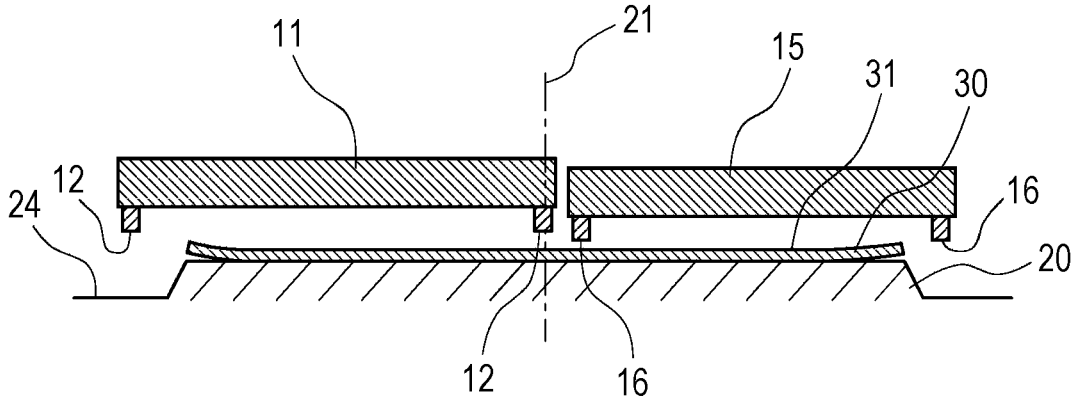
FIG. 3 is a schematic longitudinal sectional view of the vicinity of the grinding stage of the substrate grinding device according to the embodiment of the present disclosure.

FIG. 2 is a plan view of the vicinity of the grinding stage 24 of the substrate grinding device 10. FIG. 3 is a schematic longitudinal sectional view of the vicinity of the grinding stage 24. The finish grinding wheel 11 and the coarse grinding wheel 15 configured to grind the substrate 30 are, with reference to FIGS. 2 and 3, provided above the substrate 30 at the grinding stage 24.

The finish grinding wheel 11 is mainly a grinding wheel configured to perform finish grinding of the substrate 30. The coarse grinding wheel 15 is a grinding wheel configured to perform coarse grinding of the substrate 30. Thus, the particle size of the finish grinding wheel 11 is greater than the particle size of the coarse grinding wheel 15. Moreover, the diameter of the finish grinding wheel 11 is equal to the diameter of the coarse grinding wheel 15, or is larger than the diameter of the coarse grinding wheel 15.

The finish grinding wheel 11 is configured such that a grinding area thereof has a greater diameter than the radius of the work table 20, and is provided at such a position that such a grinding area includes the center 21 of rotation of the substrate 30. For example, the finish grinding wheel 11 is provided at a position passing through the center 21 of rotation of the substrate 30. With this configuration, the finish grinding wheel 11 can perform, with high accuracy, finish grinding for the entirety of the upper surface 31 of the substrate 30 as a processing target surface.

The coarse grinding wheel 15 is configured such that a grinding area thereof has a greater diameter than the radius of the work table 20, and is provided at a position not contacting the finish grinding wheel 11 in the vicinity of the center 21 of rotation of the substrate 30. With this configuration, the coarse grinding wheel 15 can perform coarse grinding for an area of the upper surface 31 from an outer peripheral portion of the substrate 30 to the vicinity of the center 21 of rotation.

That is, at the grinding stage 24, the substrate grinding device 10 can cause the coarse grinding wheel 15 to grind from the outer peripheral portion of the substrate 30 to the vicinity of the center 21 of rotation while the finish grinding wheel 11 can grind, with high accuracy, the entirety of the processing target surface of the substrate 30 including the center 21 of rotation.

As described above, the substrate 30 can be simultaneously ground by the finish grinding wheel 11 and the coarse grinding wheel 15 without the need for changing the position of the substrate 30. Thus, it is not necessary to separately provide equipment for placing a table for coarse grinding and equipment for placing a table for finish grinding. Thus, an increase in the size of the substrate grinding device 10 can be suppressed, and the large-size substrate 30 can be efficiently ground.

For example, even in a case where the substrate 30 targeted for processing is, for example, a large-size mounting substrate such as a PLP with great warpage, the substrate 30 can be simultaneously and efficiently ground by the finish grinding wheel 11 and the coarse grinding wheel 15 without the need for providing, e.g., a turn table to deliver the work table 20. As described above, according to the substrate grinding device 10, the grinding step can be implemented with high accuracy within a short period of time.

Next, the method for manufacturing the substrate by the substrate grinding device 10 will be described in detail. First, the chucking step of causing the substrate 30 to stick to the rotatable work table 20 is executed with reference to FIG. 1.

At the chucking step, the substrate 30 as the processing target object is mounted on the upper surface of the work table 20 at the standby stage 23 by, e.g., a robot. Then, the attachment housing 22 moves down from above the substrate 30, and the substrate 30 sticks to the work table 20 by vacuum suction. Then, the work table 20 holding the substrate 30 moves from the standby stage 23 to the grinding stage 24.

At the grinding stage 24, the grinding step of grinding the substrate 30 is executed. At the grinding step, the thickness of the substrate 30 is first measured by the sizing device 26. The coarse grinding wheel 15 is position-adjusted to a portion higher than the upper surface 31 (see FIG. 3) of the substrate 30 by an amount corresponding to an air cut.

At the grinding step, the substrate 30 held on the work table 20 is ground by the finish grinding wheel 11 and the coarse grinding wheel 15. The finish grinding wheel 11 and the coarse grinding wheel 15 rotate together with the work table 20, and during rotation, move down to contact the substrate 30. Note that details of the grinding step will be described later.

The substrate 30 subjected to grinding by the grinding step moves, together with the work table 20, from the grinding stage 24 to the standby stage 23. Then, after grinding, vacuum suction by the work table 20 is turned off, and the substrate 30 is detached from the work table 20.

Figure 4:
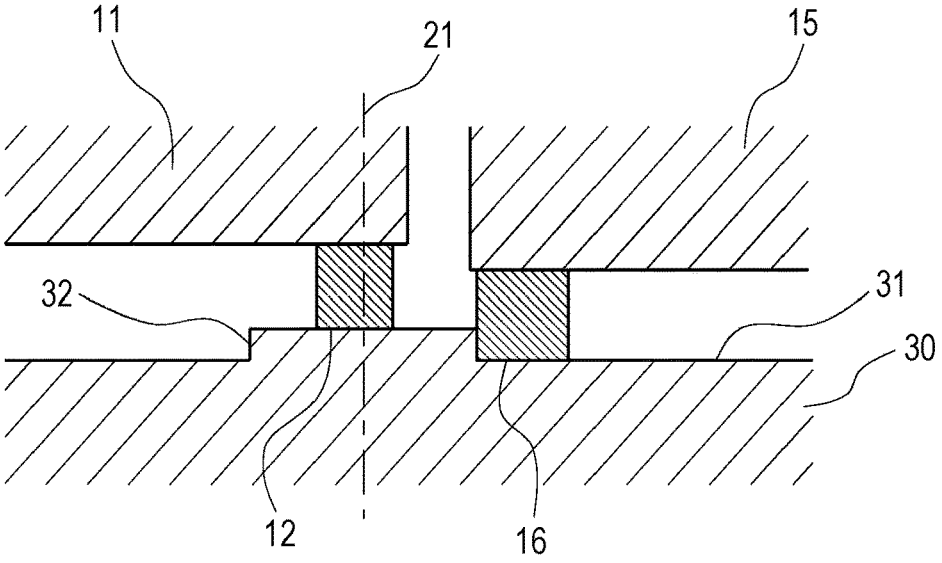
FIG. 4 is a schematic longitudinal sectional view of the substrate grinding device according to the embodiment of the present disclosure in the vicinity of the center of rotation of a substrate at a coarse grinding step.

Next, the step of grinding the substrate 30 by the substrate grinding device 10 will be described in detail with reference to FIGS. 4 to 6. FIG. 4 is a schematic longitudinal sectional view of the vicinity of the center 21 of rotation of the substrate 30 at a coarse grinding step. At the grinding step, the coarse grinding step is first executed. At the coarse grinding step, the finish grinding wheel 11 and the coarse grinding wheel 15 approach, with reference to FIG. 4, the substrate 30 to grind the substrate 30 in a state in which the coarse grinding wheel 15 is closer to the upper surface 31 of the substrate 30 than the finish grinding wheel 11 is to the upper surface 31.

A distance from the grinding wheel blade edge 12 of the finish grinding wheel 11 to the grinding wheel blade edge 16 of the coarse grinding wheel 15 on the lower side is, for example, 1 to 50 μm, and preferably 1 to 30 μm. As described above, at the coarse grinding step, grinding is performed in a state in which the coarse grinding wheel 15 is closer to the substrate 30. With this configuration, a broad area of the substrate 30 excluding the vicinity of the center 21 of rotation is efficiently ground by the grinding wheel 15 with a smaller particle size and less abrasion.

As described above, the finish grinding wheel 11 configured so that the entirety of the substrate 30 including the center 21 of rotation can be ground by the finish grinding wheel 11 moves down during rotation at the same time as that of the coarse grinding wheel 15. With this configuration, a non-ground raised portion 32 of the substrate 30 not contacting the coarse grinding wheel 15 in the vicinity of the center 21 of rotation can be coarsely ground by the finish grinding wheel 11. The grinding area of the finish grinding wheel 11 at the coarse grinding step is a narrow area in the vicinity of the center 21 of rotation. Thus, abrasion of the finish grinding wheel 11 can be reduced.

At the grinding step, the finish grinding wheel 11 and the coarse grinding wheel 15 are sent at the same cutting speed while a position relationship therebetween is maintained. The cutting speed of the finish grinding wheel 11 and the coarse grinding wheel 15 at the coarse grinding step is, for example, preferably 10 to 300 μm/minute, and more preferably 30 to 300 μm/minute. With this configuration, abrasion of the finish grinding wheel 11 and the coarse grinding wheel 15 can be reduced, and efficient high-accuracy grinding is allowed.

Figure 5:
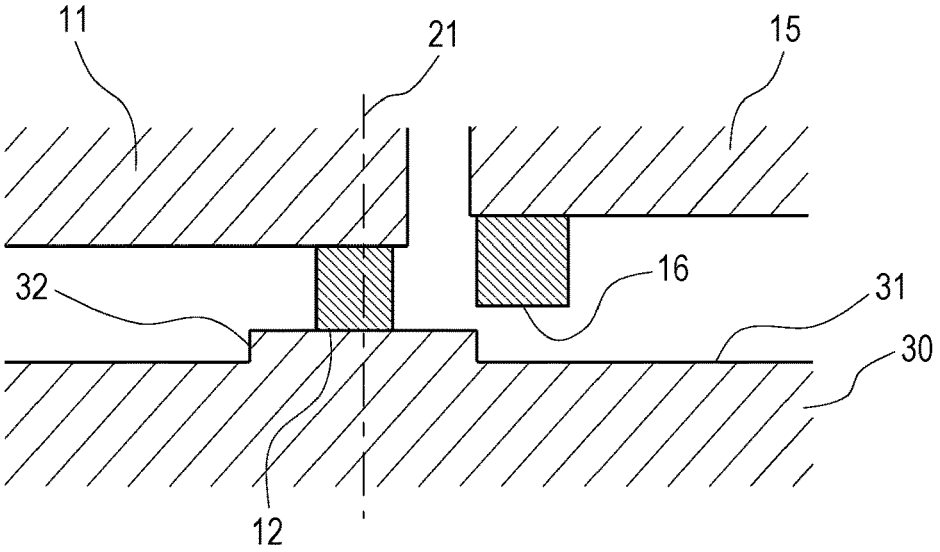
FIG. 5 is a schematic longitudinal sectional view of the substrate grinding device according to the embodiment of the present disclosure in the vicinity of the center of rotation of the substrate at a finish grinding step.

FIG. 5 is a schematic longitudinal sectional view of the vicinity of the center 21 of rotation of the substrate 30 right after the start of a finish grinding step. After the coarse grinding step has been executed, the coarse grinding wheel 15 moves higher than the finish grinding wheel 11 as illustrated in FIG. 5. That is, the grinding wheel blade edge 16 of the coarse grinding wheel 15 is arranged higher than the grinding wheel blade edge 12 of the finish grinding wheel 11, and is brought into a state in which the grinding wheel blade edge 16 is separated from the upper surface 31 of the substrate 30.

At the finish grinding step, in a state in which the coarse grinding wheel 15 does not contact the upper surface of the substrate 30, the finish grinding wheel 11 comes, during rotation thereof, into contact with the substrate 30 to grind the substrate 30. Thus, the raised portion 32 of the substrate 30, which is not ground by the coarse grinding wheel 15 due to the absence of contact with the blade edge of the coarse grinding wheel 15 at the coarse grinding step, in the vicinity of the center 21 of rotation is ground by the finish grinding wheel 11.

The cutting speed of the finish grinding wheel 11 at the finish grinding step is, for example, preferably 10 to 300 μm/minute, and more preferably 10 to 100 μm/minute. With this configuration, abrasion of the finish grinding wheel 11 can be reduced, and efficient high-accuracy finish grinding is allowed.

Figure 6:
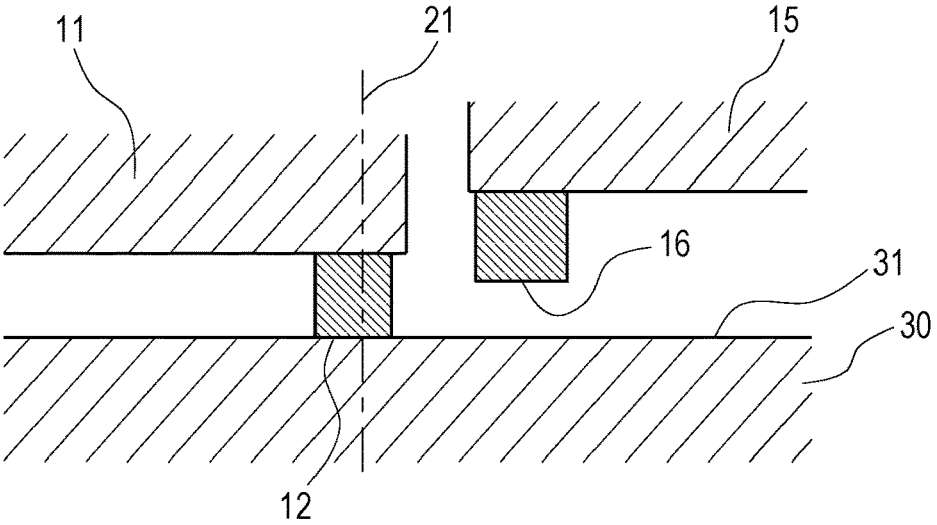
FIG. 6 is a schematic longitudinal sectional view of the substrate grinding device according to the embodiment of the present disclosure in the vicinity of the center of rotation of the substrate at the finish grinding step.

FIG. 6 is a schematic longitudinal sectional view of the vicinity of the center 21 of rotation of the substrate 30 at the finish grinding step. When the finish grinding step begins, the raised portion 32 of the substrate 30 illustrated in FIG. 5 is ground by the finish grinding wheel 11. Thereafter, as illustrated in FIG. 6, grinding of the substrate 30 by the finish grinding wheel 11 is continuously executed. Thus, the entirety of the upper surface 31 of the substrate 30 is, with high accuracy, finish-ground and flattened by the grinding wheel blade edge 12 of the finish grinding wheel 11.

Then, when the thickness of the substrate 30 measured by the sizing device 26 reaches a designated thickness by finish grinding by the finish grinding wheel 11, downward movement of the finish grinding wheel 11 is stopped. Thereafter, spark-out grinding is executed, in which rotation of the substrate 30 and the finish grinding wheel 11 is continued for a predetermined period of time in a state in which downward movement of the finish grinding wheel 11 is stopped. Thereafter, the finish grinding wheel 11 moves up, and rotation of the substrate 30 and the finish grinding wheel 11 is stopped. In this manner, the finish grinding step ends.

As described above, at the coarse grinding step, a broad area of the upper surface 31 of the substrate 30 is coarsely ground by the coarse grinding wheel 15. Thus, a machining margin of the finish grinding wheel 11 at the finish grinding step is extremely small. As a result, the amount of abrasion of the finish grinding wheel 11 is small.

Specifically, according to the substrate grinding device 10, grinding time can be reduced to equal to or shorter than about ½, and a grinding wheel running cost can be reduced to equal to or less than about ⅓ as compared to the grinding method of the typical technique for executing the entire grinding step from coarse grinding to finish grinding by a single type of grinding wheel.

Note that simultaneous grinding of the substrate 30 by the finish grinding wheel 11 and the coarse grinding wheel 15 means, for example, that a period for grinding the substrate 30 by the finish grinding wheel 11 and a period for grinding the substrate 30 by the coarse grinding wheel 15 at least partially overlap with each other.

As described above, in the present embodiment, an increase in the size of the device is suppressed while efficient grinding with a smaller number of times of delivery of the work table 20 is performed. Moreover, the amount of polishing by the finish grinding wheel 11 can be reduced while, e.g., a large-size mounting substrate can be efficiently ground with high accuracy.

Note that the embodiment of the present disclosure is not limited to the above-described embodiment, and various changes can be made without departing from the gist of the technique of the present disclosure.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. A substrate grinding device comprising:

a work table rotatable with the work table sucking and holding a substrate;

a first cup grinding wheel configured to grind the rotating substrate while rotating, the substrate being held by the work table;

a second cup grinding wheel configured to grind the substrate at the same time as grinding the substrate by the first cup grinding wheel while rotating in a close vicinity of the substrate, the second cup grinding wheel being configured to grind the substrate more coarsely than the first cup grinding wheel grinds the substrate;

wherein an abrasive grain size of the first cup grinding wheel is smaller than an abrasive grain size of the second cup grinding wheel, a grinding area of the first cup grinding wheel has a greater diameter than a radius of the work table, and the first cup grinding wheel is arranged at such a position that the grinding area includes and passes through a center of rotation of the substrate, a grinding area of the second cup grinding wheel has a greater diameter than the radius of the work table, and the second cup grinding wheel is arranged at a position not contacting the first cup grinding wheel in a vicinity of the center of rotation of the substrate, and the second cup grinding wheel is arranged at such a position that a ground area of the substrate, which is ground by the second cup grinding wheel, intersects an axis of rotation of the second cup grinding wheel, the first cup grinding wheel and the second cup grinding wheel are configured such that the first cup grinding wheel and the second cup grinding wheel simultaneously approach the substrate and simultaneously grind the substrate in a state in which the second cup grinding wheel is closer to the substrate than the first cup grinding wheel is to the substrate, and then, the first cup grinding wheel approaches the substrate and grinds the substrate in a state in which the second cup grinding wheel is separated from the substrate, and the first cup grinding wheel and the second cup grinding wheel are sent at the same cutting speed while a position relationship between the first cup grinding wheel and the second cup grinding wheel is maintained during a time in which the first cup grinding wheel and the second cup grinding wheel simultaneously grind the substrate.

2. A substrate grinding method using the substrate grinding device according to claim 1, comprising:

a step of providing the substrate grinding device of claim 1;

a chucking step of causing the substrate to stick to the work table; and a grinding step of rotating the work table to rotate the substrate held on the work table and simultaneously moving the first cup grinding wheel and the second cup grinding wheel closer to the substrate while the first cup grinding wheel and the second cup grinding wheel are rotating, thereby grinding the substrate.

3. The substrate grinding method according to claim 2, wherein during the grinding step, the first cup grinding wheel is sent to such a position that the grinding area includes the center of rotation of the substrate, and during the grinding step, the second cup grinding wheel is sent to a position not contacting the first cup grinding wheel in a vicinity of the center of rotation of the substrate.

4. The substrate grinding method according to claim 2, wherein the grinding step includes a coarse grinding step of moving the first cup grinding wheel and the second cup grinding wheel closer to the substrate to grind the substrate in a state in which the second cup grinding wheel is closer to the substrate than the first cup grinding wheel is to the substrate, and a finish grinding step executed after execution of the coarse grinding step of moving the first cup grinding wheel closer to the substrate to grind the substrate in a state in which the second cup grinding wheel is separated from the substrate.

5. The substrate grinding method according to claim 3, wherein the grinding step includes a coarse grinding step of moving the first cup grinding wheel and the second cup grinding wheel closer to the substrate to grind the substrate in a state in which the second cup grinding wheel is closer to the substrate than the first cup grinding wheel is to the substrate, and a finish grinding step executed after execution of the coarse grinding step of moving the first cup grinding wheel closer to the substrate to grind the substrate in a state in which the second cup grinding wheel is separated from the substrate.

6. The substrate grinding device according to claim 1, wherein all of the abrasive grain size of the first cup grinding wheel is smaller than all of the abrasive grain size of the second cup grinding wheel.

7. The substrate grinding device according to claim 1, wherein the abrasive grain size of an entire portion for grinding the substrate in the first cup grinding wheel is smaller than the abrasive grain size of an entire portion for grinding the substrate in the second cup grinding wheel.

8. The substrate grinding device according to claim 1, wherein an outermost circumference of the second cup grinding wheel is closer to the center of rotation of the substrate than a ¾ point of the radius of the work table.

* * * * *